US005639543A

United States Patent [19]

Isoda et al.

[11] Patent Number: 5,639,543

[45] Date of Patent: Jun. 17, 1997

[54] CUSHIONING NET STRUCTURE AND PRODUCTION THEREOF

[75] Inventors: Hideo Isoda, Ohtsu; Takashi Nishida, Ohtsu, both of Japan

[73] Assignee: Toyo Boseki Kabushiki Kaisha, Osaka, Japan

[21] Appl. No.: 201,746

[22] Filed: Feb. 25, 1994

[30] Foreign Application Priority Data

Feb. 26, 1993 [JP] Japan ..... 5-037218
Jul. 6, 1993 [JP] Japan ..... 5-167110

[51] Int. Cl.[6] ..... D04H 3/05; A47C 7/02; A47C 31/00; B32B 5/04; B68G 5/00

[52] U.S. Cl. ..... 428/220; 5/652; 114/363; 156/62.4; 297/452.13; 428/221; 428/338; 428/373; 428/374; 422/50

[58] Field of Search ..... 428/296, 221, 428/220, 338, 373, 374; 156/62.4; 5/652; 114/363; 297/452.13

[56] References Cited

U.S. PATENT DOCUMENTS 3,687,759 8/1972 Werner ..... 156/167
3,852,152 12/1974 Werner et al. .

FOREIGN PATENT DOCUMENTS 0483386 5/1992 European Pat. Off. .
869214 3/1959 United Kingdom .
1224451 3/1971 United Kingdom .
1247373 9/1971 United Kingdom .
1474047 5/1977 United Kingdom .
2214940 9/1989 United Kingdom .

*Primary Examiner*—James C. Cannon
*Attorney, Agent, or Firm*—Leydig, Voit & Mayer, Ltd.

[57] ABSTRACT

A cushioning net structure having an apparent density of 0.005–0.20 g/cm$^3$, which comprises three-dimensional random loops bonded with one another, wherein the loops are formed by allowing continuous fibers of 300 denier or more mainly comprising a thermoplastic elastomer to bend to come in contact with one another in a molten state and to be heat-bonded at most contact points, and a method for producing the net structure. The structure of the invention can provide unstuffy cushions superior in heat resistance, durability and cushioning property. The cushioning structure is advantageous in that it can be easily recycled.

47 Claims, 2 Drawing Sheets

CUSHIONING NET STRUCTURE AND PRODUCTION THEREOF

FIELD OF THE INVENTION

The present invention relates to a cushioning net structure made from a thermoplastic elastomer permitting recycled use thereof, which is superior in durability and cushioning property necessary for furniture, beds, vehicle seats, seacraft seats and so on, and to the production thereof.

BACKGROUND OF THE INVENTION

Foamed urethane, non-elastic crimped fiber battings, resin-bonded or hardened fabric made of non-elastic crimped fibers etc. are currently used as cushioning materials for furniture, beds, trains, automobiles and so on.

A foamed-crosslinked urethane has, on the one hand, superior durability as a cushioning material but has, on the other hand, poor moisture and water permeability and accumulates heat to cause stuffiness. In addition, since it is not thermoplastic, recycling of the material is difficult and waste urethane is generally incinerated. However, incineration of urethane gives great damage to incinerator as well as necessitates removal of toxic gases, thus causing great expenses. For these reasons, waste urethane is often buried in the ground. This also poses different problems in that stabilization of the ground is difficult, with the result that burying site is limited to specific places as necessary costs rise. Moreover, although urethane exhibits excellent processability, chemicals used for its production reveal a possibility of causing environmental pollution.

When a thermoplastic polyester fiber batting is used, the problems of inpersistent shape, degraded bulkiness and degraded resilience due to fiber movement and fatigue of crimps as a result of unfixed, loose relations of the fibers are caused. Incidentally, Japanese Patent Unexamined Publication Nos. 11352/1985, 141388/1986 and 141391/1986 disclose fabric of polyester fibers bonded by an adhesive such as a rubber-based adhesive. Also, Japanese Patent Unexamined Publication No. 137732/1986 discloses one using crosslinked urethane. These cushioning materials are inferior in durability and pose problems of unattainable recycling since it is not thermoplastic nor of a single composition, complicated steps for processing, pollution by the chemicals used for the production and so on. A polyester hardened fabric, such as those disclosed in Japanese Patent Unexamined Publication Nos. 31150/1983 and 220354/1991, and U.S. Pat. No. 5,141,805 is inferior in durability as demonstrated by deformed shape and lowered resilience thereof caused by the use of a brittle amorphous polymer as the bonding component for heat-bonding fibers (e.g. those disclosed in Japanese Patent Unexamined Publication Nos. 136828/1983, 249213/1991) to allow easy breakage of the bonded portions during use. As a method for overcoming the defect, Japanese Patent Unexamined Publication No. 245965/1992 proposes an interlocking treatment. Yet, the brittleness of the bonded portions which brings about marked decrease in resilience cannot be overcome by the proposed treatment. Such polyester fabric encounters with difficulties in processing thereof and in providing a soft cushioning material due to the resistance to the deforming of the bonded portions. In view of these problems, there have been proposed a heat-bonding fiber using a polyester elastomer having soft and deformation-recoverable bonded portions (Japanese Patent Unexamined Publication 240219/1992) and a cushioning material using said fiber WO-91/19032). The adhesive polyester elastomer used for this fiber structure comprises terephthalic acid in a proportion of 50–80% by mole as an acid component for a hard segment and polyalkylene glycol in a proportion of 30–50% by mole for a soft segment and isophthalic acid and so on as another acid component as in the fiber disclosed in Japanese Patent Publication No. 1404/1985 so as to increase noncrystallinity, which will result in a lowered melting point thereof to not more than 180° C. and a low melt viscosity to contribute to an improved amoeboid shape heat-bonding. Still, the fiber is susceptible to plastic deformation which causes poor heat resistance and poor resistance to compression.

Japanese Patent Unexamined Publication No. 44839/1972 discloses a thermoplastic olefin net structure suitable for use in construction works. Different from cushioning structures made of thin fibers, the surface thereof is not smooth but rough and heat-resisting durability is markedly poor due to the use of olefin as a base material, to the point it is not usable as a cushioning material. While there have been proposed net structures made from vinyl chloride for use for entrance mat etc., they are not suitable as cushioning materials in view of the fact that plastic deformation easily occurs and toxic hydrogen halide is generated upon incineration.

Accordingly, an object of the present invention is to solve the aforementioned problems and to provide a cushioning net structure which can be prossessed into unstuffy cushions having superior heat resistance, durability and cushioning function, and which can be recycled easily, and a method for the production thereof.

SUMMARY OF THE INVENTION

With the aim of achieving the above-mentioned object, the present invention provides a cushioning net structure having an apparent density of 0.005–0.20 g/cm$^3$, which comprises three-dimensional random loops bonded with one another, wherein the loops are formed by allowing continuous fibers of 300 denier or more mainly comprising a thermoplastic elastomer to bend to come in contact with one another in a molten state and to be heat-bonded at most contact points.

The present invention further provides a method for producing a cushioning net structure, comprising the steps of: (1) melting a starting material mainly comprising a thermoplastic elastomer at a temperature 10°–80° C. higher than the melting point of said elastomer; (2) delivering the molten material to the downward direction from plural orifices to form loops of continuous fibers in a molten state; (3) bringing respective loops into mutual contact to allow heat-bonding at the contact points into a three-dimensional random loop structure as being carried while interposed between take-off units; and (4) cooling the structure.

DETAILED DESCRIPTION OF THE INVENTION

Figure 1:
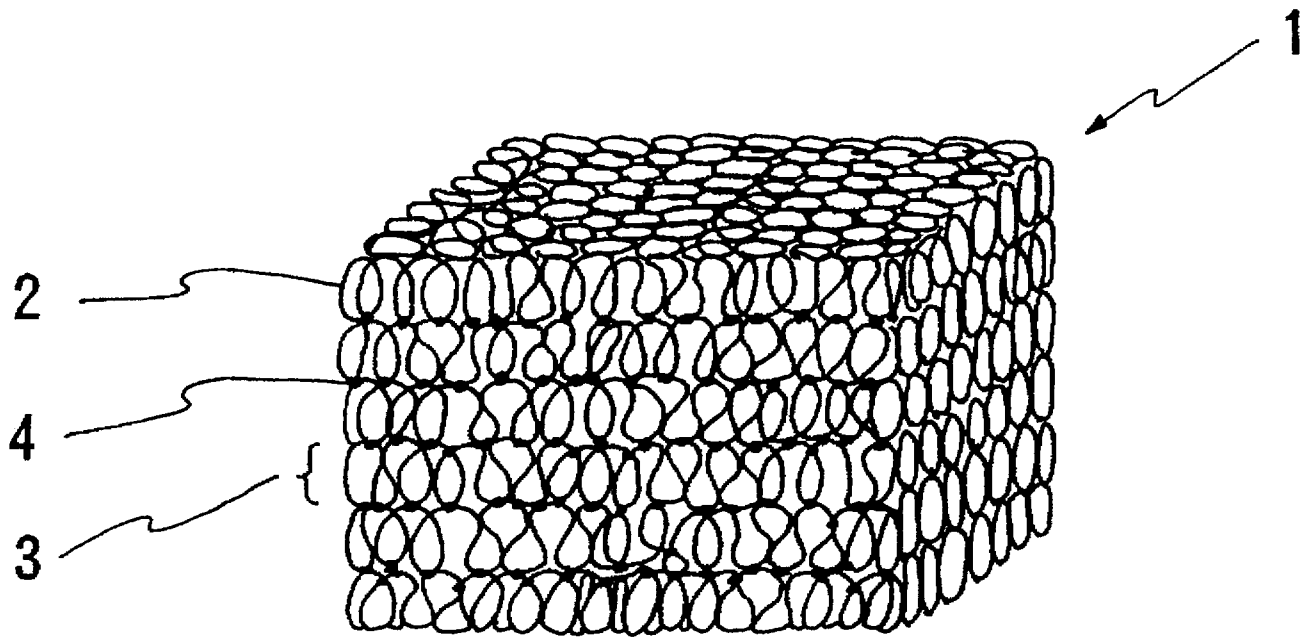
FIG. 1 shows one embodiment of the cushioning net structure of the present invention.

The net structure of the present invention has the characteristic structure as described above, and is particularly characterized by the continuous fiber mainly composed of a thermoplastic elastomer conducive to a markedly superior heat-resisting durability imparted to a cushioning material, which has never been achieved by conventional net structures.

The net structure of the present invention has a residual strain permanent set at 70° C. (which is a parameter of heat-resisting durability, to be described in detail in the following) of not more than 35%, preferably not more than 30%, more preferably not more than 20%, particularly preferably not more than 15%, and most preferably not more than 10%. As used herein, the 70° C. residual strain permanent set means a value in percent expressing a ratio of (the thickness of a specimen before treatment—the thickness of the specimen after treatment) to that before the treatment, as measured after (i) cutting out the specimen in a 15 cm×15 cm size, (ii) compressing same to 50% thereof in the thickness direction, (iii) leaving the specimen in heat dry at 70° C. for 22 hours, (iv) cooling the specimen to remove the strain caused by the compression and (v) leaving the specimen for a day. When the structure shows a residual strain permanent set of more than 35%, the desired property of the cushioning structure cannot be easily achieved.

It is essential that the continuous fibers forming the net structure of the present invention should be mainly composed of a thermoplastic elastomer. A non-elastic polymer other than the thermoplastic elastomer may be combinedly used to achieve the desired property of the net structure, in a proportion preventing the residual strain permanent set from exceeding 35%. The non-elastic polymer may be used in an amount of less than 50% by weight, more preferably less than 20% by weight based on the total amount of elastomer and non-elastic polymer. As the mode of the combined use, exemplified are a fiber made from a mixture of a thermoplastic elastomer and a thermoplastic non-elastic polymer (polymer blend), a composite fiber of a thermoplastic elastomer and a thermoplastic non-elastic polymer and so on. The composite fiber includes, for example, sheath-core structure fiber, side-by-side structure fiber, eccentric sheath-core structure fiber and so on. Also, a net structure may be composed of fibers made from a thermoplastic elastomer and fibers made from a thermoplastic non-elastic polymer.

Examples of a composite or laminate (integral bonding structure) of the net structure composed of thermoplastic elastomer fibers and thermoplastic non-elastic polymer fibers include a sandwich structure of elastomer layer/non-elastomer layer/elastomer layer, a double structure of elastomer layer/non-elastomer layer and a composite structure of matrix elastomer comprising a non-elastomer layer therein.

The net structure of the present invention may be a laminate or a composite of various net structures made of loops having different sizes, different deniers, different compositions, different densities and so on as appropriately selected, so as to meet the desired property.

The present invention also encompasses a seat cushion obtained by providing a heat-bonding layer (low melting point heat-bonding fiber or low melting point heat-bonding film) as necessary on the surface of the laminate structure and integrating by bonding same with an outerwrap wadding layer, and a cushion obtained by combining a hardened fabric cushion (preferably made from heat-bonding fiber using an elastomer) as a wadding layer which is heat-bonded to an outerwrap.

So as to particularly improve heat-resisting durability, the net structure of the present invention contains an increased amount of a fiber made from a thermoplastic elastomer. It has been confirmed that the structure composed only of thermoplastic elastomer fibers and treated for pseudo-crystallization to be mentioned later in particular shows a 70° C. residual strain permanent set of not more than 15%, specifically not more than 10%.

Examples of the preferable thermoplastic elastomer of the present invention include polyester elastomer, polyurethane elastomer and polyamide elastomer. The polyester elastomer is exemplified by polyester-ether block copolymers comprising a thermoplastic polyester as a hard segment and a polyalkylenediol as a soft segment and polyester-ester block copolymers comprising a thermoplastic polyester as a hard segment and a fatty polyester as a soft segment. Specific examples of the polyester-ether block copolymer include tertiary block copolymers comprising at least one dicarboxylic acid selected from aromatic dicarboxylic acids such as terephthalic acid, isophthalic acid, naphthalene 2,6-dicarboxylic acid, naphthalene 2,7-dicarboxylic acid and diphenyl 4,4'-dicarboxylic acid, alicyclic dicarboxylic acids such as 1,4-cyclohexanedicarboxylic acid, aliphatic dicarboxylic acids such as succinic acid, adipic acid, sebatic acid and dimer acid, and ester-forming derivatives thereof; at least one diol component selected from aliphatic diols such as 1,4-butanediol, ethylene glycol, trimethylene glycol, tetramethylene glycol, pentamethylene glycol and hexamethylene glycol, alicyclic diols such as 1,1-cyclohexanedimethanol and 1,4-cyclohexanedimethanol and ester-forming derivatives thereof; and at least one member selected from polyalkylene diols having an average molecular weight of about 300–5000, such as polyethylene glycol, polypropylene glycol, polytetramethylene glycol and ethylene oxide-propylene oxide copolymer. Examples of the polyester-ester block copolymer include tertiary block copolymers comprising at least one member each from the aforesaid dicarboxylic acids, the aforesaid diols and polyester diols having an average molecular weight of about 300–3000 (e.g. polylactone). In consideration of heat-bonding, resistance to hydrolysis, stretchability and heat resistance, preferable tertiary block copolymers comprise terephthalic acid and/or naphthalene 2,6-dicarboxylic acid as a dicarboxylic acid; 1,4-butanediol as a diol component; and polytetramethylene glycol as a polyalkylene glycol or polylactone as a polyester diol. In a special case, a polyester elastomer comprising polysiloxane for a soft segment may be used. The aforementioned polyester elastomers may be used alone or in combination. Also, a blend or a copolymer of a polyester elastomer and a non-elastomer component may be used in the present invention.

Examples of the polyamide elastomer include block copolymers comprising nylon 6, nylon 66, nylon 610, nylon 612, nylon 11, nylon 12 or copolymer nylon thereof as a skeleton for a hard segment and at least one polyalkylenediol having an average molecular weight of about 300–5000, such as polyethylene glycol, polypropylene glycol, polytetramethylene glycol or ethylene oxide-propylene oxide copolymer as a soft segment, which may be used alone or in combination. Also, a blend or a copolymer of a polyamide elastomer and a non-elastomer component may be used in the present invention.

A typical example of the polyurethane elastomer is a polyurethane elastomer prepared by chain-extending a prepolymer having isocyanate groups at both ends, which has been obtained by reacting (A) polyether and/or polyester having a number average molecular weight of 1000–6000 and having a hydroxyl group at the terminal and (B) polyisocyanate comprising an organic diisocyanate as a main component, with (C) polyamine comprising diamine as a main component, in or without a conventional solvent (e.g. dimethylformamide, dimethylacetamide). Preferable examples of the polyester and polyether (A) include polyester copolymerized with polybutylene adipate and polyalkylenediols such as polyethylene glycol, polypropylene glycol, polytetramethylene glycol and ethylene oxide-propylene oxide copolymer having an average molecular weight of about 1000–6000, preferably 1300–5000; preferable examples of polyisocyanate (B) include conventionally-known polyisocyanate and isocyanate mainly composed of diphenylmethane 4,4'-diisocyanate and added with a small amount of known triisocyanate etc. on demand; and examples of polyamine (C) include known diamines such as ethylene diamine and 1,2-propylene diamine, added with a small amount of triamine or tetramine on demand. These polyurethane elastomers may be used alone or in combination.

Of these, particularly preferable are polyester elastomer, polyamide elastomer and polyurethane elastomer which are obtained by block copolymerization of a polyether glycol, polyester glycol or polycarbonate glycol having a molecular weight of 300–5000 as a soft segment. By the use of a thermoplastic elastomer, reproduction by remelting becomes possible, thus facilitating recycled use.

In the present invention, a thermoplastic non-elastic polymer optionally used with the thermoplastic elastomer to be used as a starting material for the continuous fiber is exemplified by polyester, polyamide, polyurethane and so on. The combination of the thermoplastic elastomer and the thermoplastic non-elastic polymer is preferably that of polyester elastomer and polyester polymer, polyurethane elastomer and polurethane polymer, and polyamide elastomer and polyamide polymer, from the aspect of recycled use of the cushioning net structure.

The polyester resin is exemplified by polyethylene terephthalate (PET), polyethylene naphthalate (PEN), polycyclohexylenedimethylene terephthalate (PCHDT), polycyclohexylenedimethylene naphthalate (PCHDN), polybutylene terephthalate (PBT), polybutylene naphthalate (PBN), copolymers thereof and so on.

The polyamide resin is exemplified by polycaprolactam (NY6), polyhexamethylene adipamide (NY66), polyhexamethylene sebacamide (NY6-10), copolymers thereof and so on.

The melting point of the thermoplastic elastomer of the present invention is preferably not less than 140° C. and not more than 300°, in which range heat-resisting durability can be satisfactorily maintained. When the melting point falls within the range of from 160° C. to 300°, heat-resisting durability can be advantageously improved. The melting point of the thermoplastic non-elastomer to be used in the present invention is preferably from 200° C. to 300° C. more preferably from 240° C. to 300° C.

Where necessary, antioxidant and light resisting agent may be added for the improvement of the durability. In the present invention, addition of an antioxidant in a proportion of not less than 1% by weight and not more than 10% by weight based on the elastomer is desirable for an improved heat resistance.

The continuous fiber made from a thermoplastic elastomer and forming the net structure of the present invention particularly preferably has an endothermic peak below melting point on a melting curve determined by a differential scanning calorimeter. Those having an endothermic peak below melting point can exhibit remarkable improvement in heat resistance and resistance to fatigue as compared with those having no endothermic peak. The reason therefor is not clear but the improvement in resistance to fatigue may be attributable to the formation of pseudo-crystalline crosslinked points.

The preferable polyester elastomer to be used in the present invention is obtained by ester exchange of an acid component comprising teraphthalic acid or naphthalene 2,6-dicarboxylic acid in a proportion of 90% by mole or more, more preferably 95% by mole or more, particularly preferably 100% by mole with a glycol component, polymerization up to a necessary polymerization degree and copolymerization with a polyalkylenediol such as a polytetramethylene glycol preferably having an average molecular weight of not less than 500 and not more than 5000, particularly preferably not less than 1000 and not more than 3000 in a proportion of not less than 15% by weight and not more than 70% by weight, more preferably not less than 30% by weight and not more than 60% by weight based on the elastomer. When the content of teraphthalic acid or naphthalene 2,6-dicarboxylic acid is great, crystallinity of the hard segment is enhanced, thus resulting in less plastic deformation and improved heat resistance and fatigue resistance. Then, an annealing treatment of continuous fibers immediately after melt-heat bonding at a temperature at least 10° C. lower than the melting point results in a still improved heat resistance and fatigue resistance. In this case, the melting curve of the continuous fiber as determined by differential scanning calorimeter (DSC) more clearly shows an endothermic peak besides the melting point, which is at a temperature below the melting point. It is inferred therefrom that the annealing re-aligns the hard segment to form pseudo-crystallization-like crosslinked points, contributing to the improvement in heat resistance and fatigue resistance. Annealing to this end in the present invention is hereinafter referred to as pseudo-crystallization treatment.

As shown in FIG. 1, the net structure of the present invention has a three-dimensional random loop structure 1 afforded by a multitude of loops 3 formed by allowing continuous fibers 2 of 300 denier or above, which are mainly composed of a thermoplastic elastomer, to wind to permit respective loops to come in contact with one another in a molten state and to be heat-bonded at most of the contact points 4. Even when a great stress to cause significant deformation is given, this structure absorbs the stress with the entire net structure composed of three-dimensional random loops melt-integrated, by deforming itself; and once the stress is lifted, rubber resilience of the elastomer manifests itself to allow recovery to the original shape of the structure. When a net structure composed of continuous fibers made from a known non-elastic polymer is used as a cushioning material, plastic deformation is developed and the recovery cannot be achieved, thus resulting in poor heat-resisting durability. When the fibers are not melt-bonded at contact points, the shape cannot be retained and the structure does not integrally change its shape, with the result that a fatigue phenomenon occurs due to the concentration of stress, thus unbeneficially degrading durability and deformation resistance. The more preferable mode of melt-bonding is the state where all contact points are melt-bonded.

The fineness of the continuous fiber of the present invention is unfavorable at not more than 300 denier, since strength and repulsion become poor. The desirable fineness of the continuous fibers used in the present invention is not less than 400 denier and not more than 100000 denier, which affords repulsion. There it is more than 100000 denier, the number of the loops becomes smaller to result in poor compression characteristic which may limit the range of applicable use. It is more preferably 500 –50000 denier.

The sectional shape is not limited but it desirably has a deformed profile or hollow profile from the aspect of improved repulsion, when continuous thin fibers are aimed.

The apparent density of the net structure of the present invention, wherein the three-dimensional random loops formed by the continuous fibers are mostly heat-bonded at the contact points, is not less than 0.005 g/cm$^3$ and not more than 0.20 g/cm$^3$. Where the apparent density is less than 0.005 g/cm$^3$, the structure is unsuitable as a cushioning material since repulsion is lost, whereas where it exceeds 0.20 g/cm$^3$, the repulsion becomes too strong to sit comfortably thereon, making the structure also unsuitable as a cushioning material. The preferable apparent density in the present invention is 0.005–0.10 g/cm$^3$, more preferably 0.01–0.05 g/cm$^3$. Since the net structure of the present invention is used as a cushioning material, it desirably has a bulkiness of 0.03–0.25 g/cm$^3$, particularly preferably 0.05–0.20 g/cm$^3$ (apparent density under compression under a load of 100 g/cm$^2$) so as to offer a comfortable sitting by maintaining bulkiness, repulsion and air permeation when a person sits on a seat made therefrom. The three dimensional random loops forming the net structure of the present invention preferably have an average diameter of not more than 50 mm. Where it exceeds 50 mm, the loops are liable to extend to the thickness direction to easily develop inconsistent air gaps and non-uniform cushioning property. An average diameter of the loop to prevent the inconsistent air gap is 2–25 mm. While the thickness of the net subject is not subject to any particular limitation, it is preferably not less than 3 mm, particularly preferably not less than 5 mm, at which thickness the cushioning function is easily demonstrated.

Figure 2:
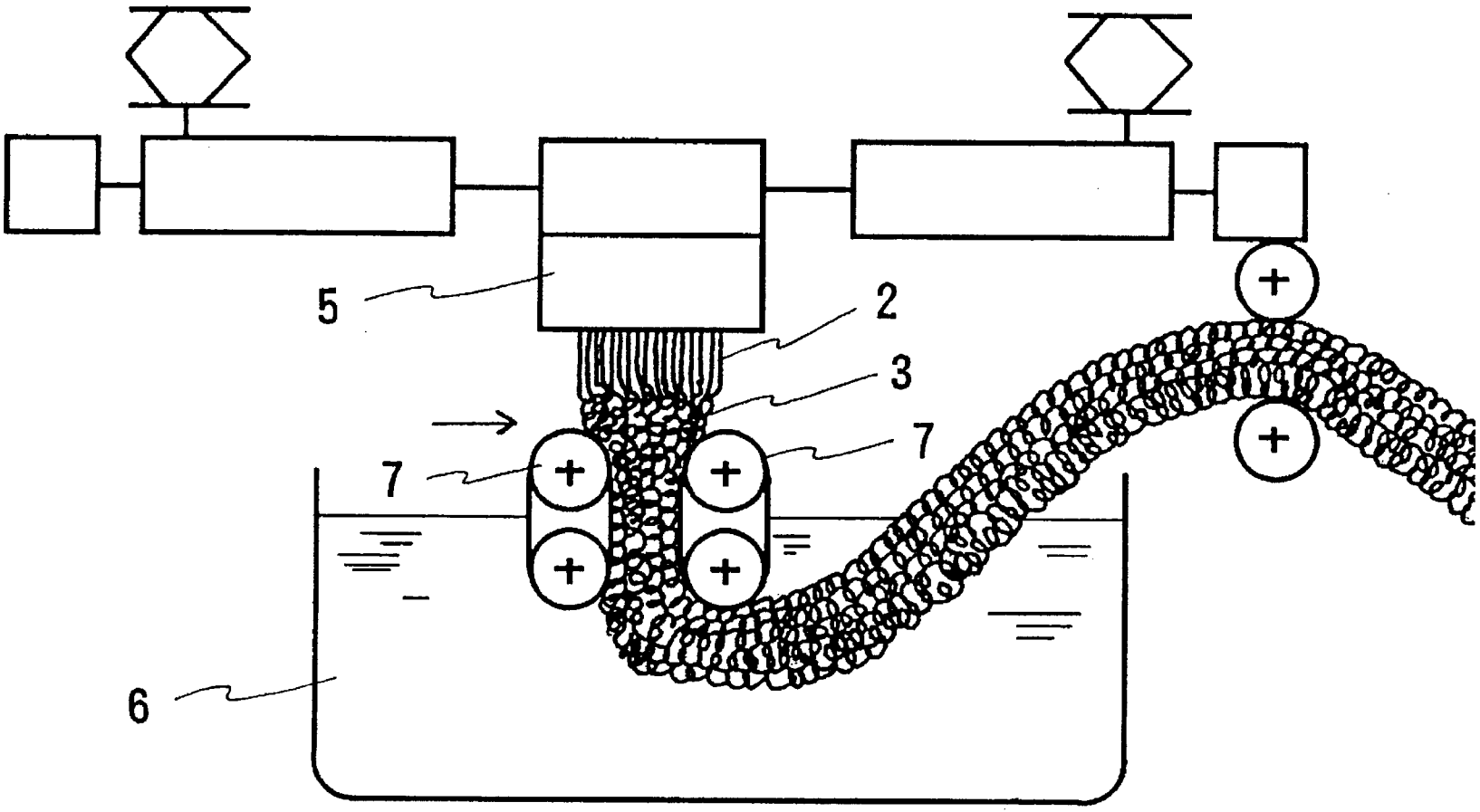
FIG. 2 shows an exemplary production process for the cushioning net structure of the present invention.

The production method of the present invention is explained in the following by referring to FIG. 2. The method for producing a cushioning net structure comprises the steps of (1) heating a molten thermoplastic elastomer obtained by a known method described, for example, in Japanese Patent Unexamined Publication No. 120626/1980, at a temperature 10°–80° C. higher than the melting point of said material in a typical melt-extruder (2) discharging the molten thermoplastic elastomer to the downward direction from a nozzle 5 with plural orifices to form loops by allowing the fibers to fall naturally. The elastomer may be combinedly used with a thermoplastic non-elastic polymer as occasion demands. The distance between the nozzle surface and take-off conveyors 7 installed on a cooling unit for solidifying the fibers, melt viscosity of the elastomer, diameter of orifice and the amount to be discharged are the elements which decide loop diameter and fineness of the fibers. Loops 3 are formed by holding and allowing the delivered molten fibers 2 to reside between a pair of take-off conveyors set on a cooling unit 6 (the distance therebetween being adjustable), bringing the loops thus formed into contact with one another by adjusting the distance between the orifices to this end such that the loops in contact are heat-bonded as they form a three-dimensional random loop structure. Then, the continuous fibers, wherein contact points have been heat-bonded as the loops form a three-dimensional random loop structure, are continuously taken into a cooling unit for solidification to give a net structure. Thereafter, the structure is cut into a desired length and shape and processed into a laminate as necessary for use as a cushioning material. The present invention is characterized in that a thermoplastic elastomer is melted and heated at a temperature 10°–80° C. higher than the melting point of said elastomer and delivered to the downward direction in a molten state from a nozzle having plural orifices. When a thermoplastic elastomer is discharged at a temperature less than 10° C. higher than the melting point, the fiber delivered becomes cool and less fluidic to result in insufficient heat-bonding of the contact points of fibers. On the other hand, when the elastomer is melted at a temperature more than 80° C. higher than the melting point, the decomposition of the thermoplastic elastomer becomes prominent, which results in unfavorably degraded rubber elasticity due to breakage of soft segments. By adjusting the temperature of the molten elastomer at the delivery to a temperature 30°–50° C. higher than the melting point, melt viscosity can be maintained relatively high and loop forming becomes desirably smooth. As a result, a three-dimensional random structure can be readily formed and the contact points are favorably heat-bonded with ease. In the preferable mode of the present invention, heat resistance and resistance to fatigue can be greatly improved by the pseudo-crystallization treatment as described above. The pseudo-crystallization treatment is performed simultaneously with cooling, by setting the temperature of a cooling unit, in which continuous fibers with loops heat-bonded at the contact points are solidified as they form a three-dimensional random loop structure, to an annealing temperature. When a drying step is involved after cooling, the drying temperature may be set to an annealing temperature to simultaneously carry out a pseudo-crystallization treatment. Also, the pseudo-crystallization treatment can be done independently. The pseudo-crystallization treatment temperature is lower than the melting point (Tm) at least by 10° C., which temperature being an alpha dispersion rise temperature (Tαcr) of Tan δ or higher. By this treatment, the structure comes to have an endothermic peak at a temperature lower than the melting point and heat resistance and resistance to fatigue of the structure can be greatly improved as compared with those which have not undergone pseudo-crystallization treatment (absence of endothermic peak). The preferable pseudo-crystallization treatment temperature in the present invention is from Tαcr+10° C. to Tm–20° C. While the endothermic peak temperature differs depending on various conditions, it is from pseudo-crystallization treatment temperature to pseudo-crystallization treatment temperature+20° C.

The loop diameter and fineness of the fibers constituting the cushioning net structure of the present invention depend on the distance between the nozzle surface and the take-off conveyor installed on a cooling unit for solidifying the elastomer, melt viscosity of the elastomer, diameter of orifice and the amount of the elastomer to be delivered therefrom. For example, a decreased amount of the thermoplastic elastomer to be delivered and a lower melt viscosity upon delivery result in smaller fineness of the fibers and smaller average loop diameter of the random loop. On the contrary, a shortened distance between the nozzle surface and the take-off conveyor installed on the cooling unit for solidifying the elastomer results in a slightly greater fineness of the fiber and a greater average loop diameter of the random loop. These conditions in combination desirably afford the desirable fineness of the continuous fibers of from 500 denier to 50000 denier and an average diameter of the random loop of not more than 50 mm, preferably 2–25 mm. By adjusting the distance to the aforementioned conveyor, the thickness of the structure can be controlled while the heat-bonded net structure is in a molten state and a structure having a desirable thickness and flat surface formed by the conveyors can be obtained. Too great a conveyor speed results in failure to heat-bond the contact points, since cooling proceeds before the heat-bonding. On the other hand, too slow a speed can cause higher density resulting from excessively long dwelling of the molten material. It is preferable, therefore, that the distance to the conveyor and the conveyor speed should be selected such that the desired apparent density of 0.005–0.1 g/cm$^3$, preferably 0.01–0.05 g/cm$^3$ can be achieved.

When the net structure of the present invention thus obtained is used as a cushioning material, it exhibits superior heat-resisting durability which the conventional cushioning materials made of an assembly of short fibers fail to achieve and the heat-resisting durability characteristic, namely, a residual strain permanent set at 70° C. of not more than 35%, preferably not more than 30%, more preferably not more than 20%, particularly preferably not more than 15%, and most preferably not more than 10% can be achieved.

When the net structure of the present invention is used as a cushioning material, the resin to be used, fineness, loop diameter and bulk density should be selected depending on the purpose of use and where it is to be used. For example, when the structure is used for a wadding for a surface layer, low density, small fineness and small loop diameter are preferable so as to impart a soft touch, adequate sinking and expansion with tension; when used as a middle layer cushioning material, medium density, great fineness and somewhat great loop diameter are preferable to decrease resonance vibration, which in turn improve shape retention with the help of adequate hardness and linear change in hysteresis under compression and keep durability. In addition, the structure of the present invention can be used for vehicle seats, seacraft seats, beds, chairs, furniture and so on upon forming the structure into a suitable shape with the use of a mold etc. to the degree the three-dimensional structure is not impaired, and covering same with an outerwrap. It is also possible to use the structure together with other cushioning materials, such as hardened cushioning material or non-woven fabric made of an assembly of short fibers, to achieve the desired property to meet the desired use. Additionally, flame proof finish, insecticidal-antimicrobial finish, resistance to heat and water, oil-repellency, color, fragrance and so on can be imparted during an optional stage from preparation of polymer to processing thereof into a molded article.

The present invention is described in detail by illustration of Examples.

The evaluation used in Examples were done according to the following methods.

1. Melting point (Tm) and endothermic peak at a temperature below melting point

The endothermic peak (melting peak) temperature is determined from a heat absorption and emission curve determined with a differential scanning calorimeter TA50, DSC50 (manufactured by Shimadzu Seisakusho, Japan) at a temperature elevating rate of 20° C./min.

2. Tαcr

A rise temperature of alpha diffusion corresponding to the transition temperature from rubber elastic region to melting region of Tan δ (ratio M"/M' obtained by dividing imaginary number resilience M" with real number M') as measured with Vibron DDVII manufactured by Orientech Corp., at 110 Hz and a temperature elevating rate of 1° C./min.

3. Apparent density

A sample material is cut into a square piece of 15 cm×15 cm in size. The volume of this piece is calculated from the thickness measured at four points. The division of the weight by the volume gives the apparent density (an average of four measurements is taken).

4. Heat-bonding

A sample was visually observed to check heat-bonding by pulling bonded loops apart with hand to see if they become apart. Those that do not come apart are considered to be heat-bonded.

5. Fineness

A sample material is cut into a square piece,of 20 cm×20 cm in size. The length of the fiber as calculated by multiplying the specific gravity of the fiber, which is based on the density gradient tubes collected from 10 sites from the sample and measured at 40° C., by a sectional area of the fiber, which is calculated from a 30-magnitude enlarged picture thereof, is converted into the weight of 9000 m thereof (an average of ten measurements is taken).

6. Average diameter of random loop

A sample material is cut into a square piece of 20 cm×20 cm in size. An average diameter of inscribed circle and circumscribed circle drawn by turning an irregularly-shaped random loop, which is formed in the longitudinal direction, for 360° is calculated (an average of twenty measurements is taken).

7. Heat-resisting durability (permanent set after compression at 70° C.)

A sample material is cut into a square piece of 15 cm×15 cm in size. This piece is 50% compressed to the thickness direction, followed by standing under heat dry at 70° C. for 22 hours and cooling to remove compression strain. The permanent set after compression at 70° C. is determined by the following equation:

$$\text{permanent set after compression at 70° C. } (\%) = \frac{A-B}{A} \times 100$$

wherein B is the thickness after standing for a day and A is its original thickness before the compression (an average of three measurements is taken).

8. Permanent set after repeated compression

A sample material is cut into a square piece of 15 cm×15 cm in size. This piece is repeatedly compressed to 50% thickness with Servo-Pulser (manufactured by Shimadzu Seisakusho, Japan) at a cycle of 1 Hz in a room at 25° C. under a relative humidity of 65%. After repeatedly compressing 20,000 times, the permanent set after repeated compression is determined by the following equation:

$$\text{permanent set after repeated compression } (\%) = \frac{A-B}{A} \times 100$$

wherein B is the thickness after standing for a day and A is its original thickness before the compression (an average of three measurements is taken).

9. Repulsion to 50% compression

A sample material is cut into a square piece of 20 cm×20 cm in size. The piece is compressed to 65% with a disc of ϕ 150 mm using Tensilon (manufactured by Orientech Corp.) and repulsion to 50% compression is determined from a stress-strain curve obtained (an average of three measurements is taken).

10. Apparent density under 100 g/cm$^2$ load

A sample material is cut into a square piece of 20 cm×20 cm in size. The piece is compressed to 40 kg with a 25 cm×25 cm compression plate using Tensilon (manufactured by Orientech Corp.) and the thickness thereof is measured. The apparent volume is determined therefrom and divided by the weight of the cut-out piece (an average of four measurements is taken).

EXAMPLES 1–3

Dimethyl terephthalate (DMT) or dimethyl naphthalate (DMN) and 1,4-butanediol (1.4BG) were charged together with a small amount of a catalyst and the mixture was subjected to ester exchange by a conventional method. Then, polytetramethylene glycol (PTMG) was added thereto and the mixture was subjected to polycondensation with increasing temperature and decreasing pressure, thereby to afford polyether-ester block copolymer elastomers. Thereto was added an antioxidant in a proportion of 1% by weight of the elastomer and the mixture was mixed, kneaded and pelletized, followed by vacuum drying at 50° C. for 48 hours to give thermoplastic elastomer raw materials, the compositions of which are shown in Table 1.

TABLE 1

| Experiment | hard segmt. | | soft segment | | | resin property | |
|---|---|---|---|---|---|---|---|
| No. | acid | glycol | component | M | content* | Tm | Tαcr |
| A-1 | DMT | 1.4BG | PTMG | 2000 | 58% | 179° C. | 58° C. |
| A-2 | DMT | 1.4BG | PTMG | 1000 | 28% | 205° C. | 62° C. |
| A-3 | DMN | 1.4BG | PTMG | 2000 | 28% | 227° C. | 68° C. |

Note:
*Percent by weight based on the elastomer.

The obtained thermoplastic elastomer materials were respectively melted at a temperature 40° C. higher than the melting point of each thermoplastic elastomer and delivered from a nozzle having orifices of 0.5 mm which were arrayed at an orifice pitch of 5 mm on a 50 cm wide, 5 cm long nozzle effective area at a single orifice delivery amount (throughput) of from 0.5 to 1.5 g/min·hole. Cooling water was placed 50 cm below the nozzle surface and a pair of 60 cm wide take-off conveyors of endless stainless nets were disposed in parallel relation to each other at a 5 cm distance in such a manner that part thereof protrude from the water surface. The delivered elastomer was received by the conveyors and allowed to be heat-bonded at the contact points as being held in between the conveyors and transported into the cooling water heated to 70° C. at a speed of 1 m/min for solidification and simultaneous pseudo-crystallization treatment, after which the obtained structure was cut into a desired size to give a net structure. The properties of the flat-surfaced net structure thus obtained are shown in Table 2. The fineness of the fiber and an average loop diameter of each net structure were 4300 denier and 7.5 mm for Example 1, 12600 denier and 9.8 mm for Example 2 and 13400 denier and 10.2 mm for Example 3. The net structure of Example 1 was soft, offering an adequate sinking and had good heat-resisting durability, which was suitable for use as a cushioning material. The structures of Examples 2 and 3, although a little stiff, had superior shape retention and heat-resisting durability, which were suitable for use as cushioning materials.

TABLE 2

| | resin used | through-put g/min/hole | pseudo-crystal-lization | apparent density g/cm³ | endothermic peak besides Tm | melt-bond-ing | 70° C. residual strain perma-nent set (%) | residual strain after repeated compression (%) | 50% repul-sion (kg) |
|---|---|---|---|---|---|---|---|---|---|
| Example 1 | A-1 | 0.5 | done | 0.01 | 82° C. | fine | 8.2 | 1.3 | 12 |
| Example 2 | A-2 | 1.5 | done | 0.03 | 83° C. | fine | 12.5 | 1.6 | 35 |
| Example 3 | A-3 | 1.5 | done | 0.03 | 83° C. | fine | 9.0 | 1.4 | 33 |
| Comp. Ex 1 | PP | 1.5 | none | 0.03 | none | fine | 47.8 | 16.2 | 128 |
| Comp. Ex 2 | PET | 1.5 | none | 0.03 | none | fine | 42.7 | 14.3 | 135 |
| Comp. Ex 3 | A-1 | 0.3 | done | 0.003 | 82° C. | fine | 7.4 | 1.2 | 4 |
| Comp. Ex 4 | A-2 | 6.5 | done | 0.29 | 83° C. | fine | 22.7 | 8.8 | 118 |
| Comp. Ex 5 | A-2 | 7.0 | done | 0.02 | 83° C. | poor | 19.0 | 11.4 | 13 |
| Example 4 | A-2 | 1.5 | done | 0.16 | 83° C. | fine | 13.3 | 1.8 | 68 |
| Comp. Ex 6 | A-2 | 0.05 | none | 0.008 | 82° C. | fine | 28.2 | 11.3 | 6 |
| Example 5 | 150B | 16.0 | none | 0.12 | — | fine | 23.2 | 8.4 | 49 |
| Example 6 | 1064 | 16.0 | none | 0.12 | — | fine | 19.3 | 4.9 | 34 |

Comparative Examples 1,2

Polypropylene (PP) with a melt flow index of 35 and polyethylene terephthalate (PET) with a specific viscosity of 0.63 were melted at 220° C. and 280° C., respectively, and delivered from a nozzle having 0.5 mm orifices which were arrayed at an orifice pitch of 5 mm on a 50 cm wide, 5 cm long nozzle effective area at a throughput of 1.5 g/min·hole. Cooling water was placed 50 cm below the nozzle surface and a pair of 60 cm wide take-off conveyors of endless stainless nets were disposed in parallel relation to each other at a 5 cm distance in such a manner that part thereof protrude from the water surface. The delivered elastomer was received by the conveyors and allowed to be heat-bonded at the contact points as being held in between the conveyors and transported into the cooling water at 20° C. at a speed of 1 m/min for solidification and simultaneous pseudo-crystallization treatment, after which the obtained structure was cut into a desired size to give a net structure. The properties of the flat-surfaced net structure thus obtained are shown in Table 2. The net structure of Comparative Example 1 was made from polypropylene, which is a non-elastic polymer with poor heat resistance, and was inferior in heat-resisting durability to the extent that it was unsuitable for use as a cushioning material; and the structure of Comparative Example 2 was made from polyethylene terephthalate, which is a non-elastic polymer with good heat resistance, and was very stiff to make the sitting thereon uncomfortable to the degree that it was unsuitable for use as a cushioning material.

Comparative Examples 3–5

The properties of the net structure obtained in the same manner as in Example 1 except for a throughput of 0.3 g/min·hole and take-off conveyor speed of 2 m/min; of the net structure obtained in the same manner as in Example 2 except for a throughput of 6.5 g/min·hole and take-off conveyor speed of 50 cm/min; and of the net structure obtained in the same manner as in Example 2 except for the location of the take-off conveyor which was below the cooling water surface are shown in Table 2.

The net structure of Comparative Example 3 had small apparent bulk density to result in low repulsion when given compression and gave an obvious impression of bottoming. The structure was significantly uncomfortable to sit on and unsuitable as a cushioning material. The net structure of Comparative Example 4 had high density to cause too much repulsion, such that the material was felt stiff and rather uncomfortable to sit on. The structure was difficult for use as a cushioning material. The net structure of Comparative Example 5 comprised fibers not heat-bonded, so that the shape retention was extremely poor. The structure was unsuitable for use as a cushioning material.

EXAMPLE 4

The properties of the net structure obtained in the same manner as in Example 2 except for a throughput of 7 g/min·hole are shown in Table 2. The net structure of Example 4 had a somewhat higher density, and resonance vibration could be made less. This structure showed rather stiff repulsion and superior heat-resisting durability and was suitable for use as a cushioning material.

Comparative Example 6

The properties of the net structure obtained in the same manner as in Comparative Example 1 except for a throughput of 0.06 g/min·hole from a nozzle having 0.5 mm orifices which were arrayed at an orifice pitch of 2 mm on a 50 cm wide, 5 cm long nozzle effective area, a take-off conveyor speed of 150 cm/min, the location of the cooling water which was 10 cm below the nozzle surface, and 60 cm wide take-off conveyors of endless stainless nets disposed in parallel relation to each other at 5 cm distance in such a manner that part thereof protrude from the water surface, are as shown in Table 2. The fineness of the fiber and average loop diameter of this net structure were 260 denier and 3.0 mm. The net structure of Comparative Example 6 had such a great fineness of the fiber to cause great sinking and poor shape retention, and was rather unsuitable for use as a cushioning material.

EXAMPLES 5,6

Polyester elastomer (P150B, manufactured by Toyo Boseki Kabushiki Kaisha, Japan) and A1064D (manufactured by Toyo Boseki Kabushiki Kaisha, Japan) as a polyurethane elastomer were spinned from a nozzle with fifty 0.6 mm orifices in a 30 cm wide, 5 cm thick area at a throughput of 0.8 kg/min·hole. Cooling water was placed 50 cm below the nozzle surface and a pair of 50 cm wide take-off conveyors of endless stainless nets were disposed in parallel relation to each other at 5 cm distance in such a manner that part thereof protrude from the water surface, together with a unit to form various angles to the water surface. The delivered elastomer was received by the conveyors into water and allowed to form a three-dimensional structure net assembly. The assembly heat-bonded at the contact points was allowed to solidify in water and cut into a desired size to give a cushioning material having an average fineness of 7000 denier, average loop diameter of 20 mm and air gap 94% or an average fineness of 10000 denier, average loop diameter of 25 mm and air gap 93%. The properties of the obtained cushioning materials are shown in Table 2. The structures of Examples 5 and 6 had somewhat higher densities and resonance vibration could be made less. The structures showed repulsion and heat-resisting durability that rendered themselves suitable for use as cushioning materials for seats.

EXAMPLE 7

The net cushioning material obtained in Example 2 was cut into a seat shape, heat-formed at 160° C. into a bucket seat cushioning mold product, which was set on a seat frame and wrapped with a polyester moquette outerwrap to give a seat. The seat was placed in a room of 30° C. and an RH of 75%. A panelist was seated thereon for 4 hours to constantly evaluate bottoming, stuffiness and physical tiredness felt in the waist.

As a result, bottoming and stuffiness were seldom felt and the seat was comfortable to sit on without giving much fatigue to the waist.

Comparative Example 7

Using the net cushioning material as obtained in Comparative Example 1, a seat was prepared in the same manner as in Example 7. The same evaluation was run as in Example 7. As a result, the buttocks became warm from sitting thereon with a little feeling of stuffiness. The impression of bottoming, and physical tiredness in the waist were so prominent that it was not possible to be seated on the seat for more than about an hour. The seat made of a cushioning material different from the present invention was uncomfortable to sit on.

EXAMPLE 8

In the same manner as in Example 2 except for a 120 cm wide, 12 cm long nozzle effective area, 140 cm wide endless stainless nets of the take-off conveyors and a 12 cm distance taken therebetween, a net structure was produced (cut in 2 m long). The properties thereof, fineness of the fiber and average diameter of the loop were the same as those in Example 2. This net structure was cut into a 110 cm wide piece and placed in a 110 cm wide, 200 cm long, 12 cm thick quilt outerwrap of a flame-proof polyester fabric to give a mattress.

The mattress was placed on a bed frame and 4 panelists were allowed to use same in a room at 25° C. and an RH of 65% for 7 hours to see if it was comfortable to sleep thereon. The bed was wrapped with a sheet. A coverlet used contained 1.8 kg down/feather (90/10) therein and a pillow used was that each panelist had been using every day. As a result, the bed was found to be comfortable, giving no impression of bottoming, no stuffiness but allowing adequate sinking. For comparison, a similar mattress was produced from a foamed urethane sheet having a density of 0.04 g/cm$^3$ and a thickness of 10 cm, which was placed on a bed frame to examine if it could offer a comfortable sleep thereon. As a result, the mattress was found to be uncomfortable to sleep on, since it developed great sinking and it became somewhat stuffy, though it gave less impression of bottoming.

Comparative Example 8

In the same manner as in Comparative Example 1 except a 120 cm wide, 12 cm long nozzle effective area, 140 cm wide endless stainless nets of the take-off conveyors and a 12 cm distance taken therebetween, a net structure was produced (cut in 2 m long). The properties thereof, fineness of the fiber and average diameter of the loop were the same as those in Comparative Example 1. This net structure was cut into a 110 cm wide piece and placed in a 110 cm wide, 200 cm long, 12 cm thick quilt outerwrap of a flame-proof polyester fabric to give a mattress. The mattress was placed on a bed frame and the comfortableness to sleep thereon was evaluated in the same manner as in Example 8. As a result, the bed was found to be uncomfortable, since it gave a greater sense of bottoming which might be due to less sinking and stiffness to even cause pain in the body part which had been in direct contact with the bed mattress, that awakened a sleeper thereon, and in addition, it grew stuffy.

EXAMPLE 9

The net structure obtained in Example 8 was cut into a 58 cm wide, 58 cm long cushion and covered with a moquette outerwrap of a polyester fabric. Quilt was inserted into a cushion to be placed on a seat frame at 4 sites and a cushion to be placed against the back at 2 sites and respectively placed on the seat and against a chair back. In the same manner as in Example 7, comfortableness while sitting was evaluated. As a result, the cushion placed against the back showed adequate repulsion and the cushion placed on the seat scarcely conveyed an impression of bottoming nor stuffiness and did not make the waist tired, which result proved that the sofa was comfortable to sit on.

Comparative Example 9

The net structure obtained in Comparative Example 8 was cut into the same cushions as in Example 9 and placed on a seat or against a chair back as in Example 9. The comfortableness while sitting was evaluated. As a result, the cushion placed against the back was felt stiff to cause foreign sensation and the cushion placed on the seat conveyed strong impression of bottoming and stuffiness, giving pain to the buttocks, which result proved that the sofa was too uncomfortable to sit on for a long time.

EXAMPLE 10

The net structure obtained in Example 6 was cut into a 38 cm wide and 40 cm long square piece with round corners. It was covered with a moquette outerwrap of a polyester fabric and placed on an office chair. The comfortableness while sitting was evaluated in the same manner as in Example 7. As a result, the cushion scarcely conveyed an impression of bottoming nor stuffiness and did not make the waist tired, which result proved that the office chair was comfortable to sit on.

EXAMPLE 11

The thermoplastic elastomer polyester (A-1) obtained in Example 1 and a thermoplastic non-elastomer polybutylene terephthalate (PBT) having a relative viscosity of 1.08 and melting point of 239° C. were melted in two extruders. Using a nozzle having a total orifice number of 906 (11 rows in the longitudinal direction at an orifice pitch of 5 mm and an orifice diameter of 0.8 mm for the first to the 6th and 11th rows; and at an orifice pitch of 10 mm and an orifice diameter of 1.0 mm for the 7th to the 10th rows), A-1 was distributed to the rows of from the 1st to the 3rd and the 11th and PBT was distributed to the rows of from the 4th to the 10th, followed by discharging at a melt temperature of 265° C. and at a throughput of 1.26 g/min·hole for A-1; 0.82 g/min·hole for PBT from the 4th row to the 6th row; and 2.00 g/min·hole for PBT from the 7th row to the 10th row. Cooling water was placed 10 cm below the nozzle surface and a pair of 60 cm wide take-off conveyors of endless stainless nets were disposed in parallel relation to each other at 5 cm distance in such a manner that part thereof protrude from the water surface. The delivered elastomer was received by the conveyors and allowed to be heat-bonded at the contact points as being held in between the conveyors and transported into the cooling water at 70° C. at a speed of 1 m/min for solidification, after which the obtained structure was cut into a desired size to give a net structure. The properties of the net structure thus obtained are shown in Table 3. The average apparent density was 0.047 g/cm$^3$ and the apparent density and thickness of each row were: 0.061 g/cm$^3$ and about 12.5 mm for the 1st to the 3rd rows (front) of A-1, 0.102 g/cm$^3$ and about 3 mm for the 11th row (rear) of A-1, 0.033 g/cm$^3$ and about 15 mm for the rows of from the 4th to the 6th of PBT and 0.041 g/cm$^3$ and about 20 mm for the rows of from the 7th to the 10th. The rows of A-1 were substantially flat and dense with a great number of loops.

TABLE 3

| | Example 11 | Example 12 | Example 13 |
|---|---|---|---|
| resin used | A-1/PBT | A-1/PBT | A-1/PBT |
| throughput (g/min · hole) | 1.26/2.0/0.82 | 1.3/2.0 | 2.0 |
| pseudo-crystallization | done | done | done |
| apparent density (g/cm$^{3)}$ | 0.047 | 0.057 | 0.045 |
| endothermic peak other than melting point | 83° C. | 83° C. | 83° C. |
| heat-bonding | fine | fine | fine |
| 70° C. residual strain permanent set (%) | 18.3 | 16.2 | 22.1 |
| strain permanent set after repeated compression (%) | 4.6 | 4.2 | 3.8 |
| 50% repulsion (kg) | 51 | 46 | 43 |

The structure of Example 11 had superior heat-resisting durability which gave good adaptability when formed into a cushioning structure.

EXAMPLE 12

In the same manner as in Example 11 except that PBT (polybutylene phthalate) was extruded from the 5th to the 10th and from the 53th to the 58th orifices in the 5th row, from the 5th to 12th and from the 51st to the 58th in the 6th row, from the 4th to the 9th and from the 42nd to the 48th orifices in the 7th row and from the 4th to the 48th orifices in the rows of from the 8th to the 10th and at a throughput of PBT of 1.3 g/min·hole from 0.8 mm diameter orifice and 2.0 g/min·hole from 1.0 mm diameter orifice; at a throughput of A-1 of 1.3 g/min·hole from 0.8 mm diameter orifice and 2.0 g/min·hole from 1.0 mm diameter orifice, a net structure was obtained. The average apparent density of the structure obtained was 0.057 g/cm$^3$.

The structure was cut into a 50 cm long piece, covered with an outerwrap and placed on a seat frame to examine the comfortableness while sitting. The sinking of the buttocks was adequate with the side thereof retaining some repulsion. The structure was suitable for use as a cushion for a seat.

EXAMPLE 13

In the same manner as in Example 11 except that orifices were disposed at a row pitch of 5 mm and an orifice pitch of 10 mm in a 50 cm wide, 5 cm long nozzle effective area and (A-1) as a sheath component and PBT (the same as in Example 11) as a core component at a ratio of 50%/50% by weight were discharged from a composite spinning nozzle capable of distributing into sheath-core at a throughput of 2 g/min·hole, a net structure was obtained. The properties of the structure are shown in Table 3.

The net structure of Example 13 showed superior movement of the bonded points and relatively superior resistance to fatigue upon repeated compressions even when a non-elastomer was combinedly used.

The cushioning net structure of the present invention has superior heat-resisting durability, is bulky and has adequate repulsion when given a compression. Since it has a net structure, it does not grow stuffy and is suitable for a cushioning material to be used for vehicle seats, seacraft seats, cushions for furniture, bedding material and so on and affords comfortable sitting. In addition, the structure of the invention is advantageous in that it permits recycled use of the material.

What is claimed:

1. A cushioning net structure having an apparent density of 0.005–0.20 g/cm$^3$, which comprises three-dimensional random loops bonded with one another, wherein the loops are formed by allowing continuous fibers of 300 denier or more mainly comprising a thermoplastic elastomer to bend to come into contact with one another in a molten state and to be heat bonded at most contact points, wherein the structure has a residual strain permanent set at 70° C. of not more than 20% wherein the continuous fiber is composed of a polymer having an endothermic peak below a melting point on a melting curve determined by a differential scanning calorimeter.

2. The net structure of claim 1, wherein the thermoplastic elastomer is a polyester elastomer, a polyurethane elastomer or a polyamide elastomer.

3. The net structure of claim 1, wherein the structure has a residual strain permanent set at 70° C. of not more than 15%.

4. The net structure of claim 1, wherein the structure has a residual strain permanent set at 70° C. of not more than 10%.

5. The net structure of claim 1, wherein the structure is composed of a thermoplastic elastomer and a thermoplastic non-elastomer.

6. The net structure of claim 1, wherein the structure is a laminate of a net structure of a continuous fiber composed of a thermoplastic elastomer and a net structure of a continuous fiber composed of a thermoplastic non-elastomer.

7. The net structure of claim 1, wherein the continuous fiber is a composite fiber composed of a thermoplastic elastomer and a thermoplastic non-elastomer.

8. The net structure of claim 1, wherein the continuous fiber has a fineness of 400–100000 denier.

9. The net structure of claim 1, wherein the continuous fiber has a fineness of 500–50000 denier.

10. The net structure of claim 1, wherein the diameter of the random loop is not more than 50 mm.

11. The net structure of claim 1, wherein the diameter of the random loop is 2–25 mm.

12. The net structure of claim 1, wherein the structure has an apparent density of 0.005–0.10 g/cm$^3$.

13. The net structure of claim 1, wherein the structure has an apparent density of 0.01–0.05 g/cm$^3$.

14. The net structure of claim 1, wherein the thickness of the structure is not less than 3 mm.

15. The net structure of claim 1, wherein the thickness of the structure is not less than 5 mm.

16. A seat for automobile or seacraft, comprising a cushioning net structure having an apparent density of 0.005–0.20 g/cm$^3$, which comprises three-dimensional random loops bonded with one another, wherein the loops are formed by allowing continuous fibers of 300 denier or more mainly comprising a thermoplastic elastomer to bend to come into contact with one another in a molten state and to be heat bonded at most contact points, wherein the structure has a residual strain permanent set at 70° C. of not more than 20% wherein the continuous fiber is composed of a polymer having an endothermic peak below a melting point on a melting curve determined by a differential scanning calorimeter.

17. A furniture comprising a cushioning net structure having an apparent density of 0.005–0.20 g/cm$^3$, which comprises three-dimensional random loops bonded with one another, wherein the loops are formed by allowing continuous fibers of 300 denier or more mainly comprising a thermoplastic elastomer to bend to come into contact with one another in a molten state and to be heat bonded at most contact points, wherein the structure has a residual strain permanent set at 70° C. of not more than 20% wherein the continuous fiber is composed of a polymer having an endothermic peak below a melting point on a melting curve determined by a differential scanning calorimeter.

18. The furniture of claim 17, which is a bed.

19. A cushioning net structure having an apparent density of 0.005 to 0.20 g/cm$^3$, said cushioning net structure comprising a plurality of three-dimensional random loops, each of said random loops melt-bonded to at least one additional loop, each of said loops comprising a thermoplastic elastomeric fiber having a fineness of a 300 denier or more, wherein the structure has a residual strain permanent set at 70° of not more than 20%, wherein the continuous fiber is composed of a polymer having an endothermic peak below a melting point on a melting curve determined by a differential scanning calorimeter.

20. The net structure of claim 19, wherein said thermoplastic elastomer is a polyester elastomer, a polyurethane elastomer, or a polyamide elastomer.

21. The net structure of claim 19, wherein the structure has a residual strain permanent set at 70° C. of not more than 15%.

22. The net structure of claim 19, wherein the structure has a residual strain permanent set at 70° C. of not more than 10%.

23. The net structure of claim 19, wherein the structure is composed of a thermoplastic elastomer and a thermoplastic non-elastomer.

24. The net structure of claim 19, wherein the structure is a laminate of a net structure of a continuous fiber composed of a thermoplastic elastomer and a net structure of a continuous fiber composed of a thermoplastic non-elastomer.

25. The net structure of claim 19, wherein the continuous fiber is a composite fiber composed of a thermoplastic elastomer and a thermoplastic non-elastomer.

26. The net structure of claim 19, wherein the continuous fiber has a fineness of 400–100000 denier.

27. The net structure of claim 19, wherein the continuous fiber has a fineness of 500–50000 denier.

28. The net structure of claim 19, wherein the diameter of the random loop is not more than 50 mm.

29. The net structure of claim 19, wherein the diameter of the random loop is 2–25 mm.

30. The net structure of claim 19, wherein the structure has an apparent density of 0.005–0.10 g/cm$^3$.

31. The net structure of claim 19, wherein the structure has an apparent density of 0.01–0.05 g/cm$^3$.

32. The net structure of claim 19, wherein the thickness of the structure is not less than 3 mm.

33. The net structure of claim 19, wherein the thickness of the structure is not less than 5 mm.

34. A cushioning net structure having an apparent density of 0.005–0.20 g/cm$^3$, which comprises three-dimensional random loops bonded with one another, wherein the loops are formed by allowing continuous fibers of 300 denier or more mainly comprising a thermoplastic elastomer to bend to come into contact with one another in a molten state and to be heat bonded at most contact points, wherein the continuous fiber is a composite fiber composed of a thermoplastic elastomer and a thermoplastic non-elastomer.

35. A cushioning net structure having an apparent density of 0.005–0.20 g/cm$^3$, which comprises three-dimensional random loops bonded with one another, wherein the loops are formed by allowing continuous fibers of 300 denier or more mainly comprising a thermoplastic elastomer to bend to come into contact with one another in a molten state and to be heat bonded at most contact points, wherein the structure has a residual strain permanent set at 70° C. of not more than 35%, wherein the structure is composed of a thermoplastic elastomer and a thermoplastic non-elastomer.

36. A cushioning net structure having an apparent density of 0.005–0.20 g/cm$^3$, which comprises three-dimensional random loops bonded with one another, wherein the loops are formed by allowing continuous fibers of 300 denier or more mainly comprising a thermoplastic elastomer to bend to come into contact with one another in a molten state and to be heat bonded at most contact points, wherein the structure has a residual strain permanent set at 70° C. of not more than 35%, wherein the structure is a laminate of a net structure of a continuous fiber composed of a thermoplastic elastomer and a net structure of a continuous fiber composed of a thermoplastic non-elastomer.

37. A cushioning net structure having an apparent density of 0.005–0.20 g/cm$^3$, which comprises three-dimensional random loops bonded with one another, wherein the loops are formed by allowing continuous fibers of 300 denier or more mainly comprising a thermoplastic elastomer to bend to come into contact with one another in a molten state and to be heat bonded at most contact points, wherein the structure has a residual strain permanent set at 70° C. of not more than 35%, wherein the continuous fiber is a composite fiber composed of a thermoplastic elastomer and a thermoplastic non-elastomer.

38. A method for producing a cushioning net structure comprising the steps of:

(1) melting a starting material mainly comprising a thermoplastic polyurethane elastomer at a temperature 10°–80° C. higher than the melting point of said elastomer, (2) discharging the molten thermoplastic elastomer to the downward direction from plural orifices to obtain loops of continuous fibers in a molten state, (3) allowing respective loops to come into contact with one another and to be heat-bonded whereby to form a three-dimensional random loop structure as they are held between take-off units, and (4) cooling the structure, wherein the structure has a residual strain permanent set at 70° C. of not more than 35%.

39. A method for producing a cushioning net structure comprising the steps of:

(1) melting a starting material mainly comprising a thermoplastic elastomer at a temperature 10°–80° C. higher than the melting point of said elastomer, (2) discharging the molten thermoplastic elastomer to the downward direction from plural orifices to obtain loops of continuous fibers in a molten state, (3) allowing respective loops to come into contact with one another and to be heat-bonded whereby to form a three-dimensional random loop structure as they are held between take-off units, (4) cooling the structure, and (5) after cooling, annealing the structure at a temperature at least 10° C. lower than the melting point of the elastomer wherein the structure has a residual strain permanent set at 70° C. of not more than 35%.

40. A method for producing a cushioning net structure comprising the steps of:

(1) melting a starting material mainly comprising a thermoplastic elastomer at a temperature 10°–80° C. higher than the melting point of said elastomer, (2) discharging the molten thermoplastic elastomer to the downward direction from plural orifices to obtain loops of continuous fibers in a molten state, (3) allowing respective loops to come into contact with one another and to be heat-bonded whereby to form a three-dimensional random loop structure as they are held between take-off units, (4) cooling the structure, and (5) after cooling, annealing the structure at a temperature at least 10° C. lower than the melting point of the elastomer, wherein the structure has a residual strain permanent set at 70° C. of not more than 20%, wherein the continuous fiber is composed of a polymer having an endothermic peak below a melting point on a melting curve determined by a differential scanning calorimeter.

41. The method of claim 40, wherein the thermoplastic elastomer is a polyester elastomer, a polyurethane elastomer or a polyamide elastomer.

42. The method of claim 40, wherein the continuous fiber has a fineness of 400–100000 denier.

43. The method of claim 40, wherein the continuous fiber has a fineness of 500–50000 denier.

44. The method of claim 40, wherein the diameter of the random loop is not more than 50 mm.

45. The method of claim 40, wherein the diameter of the random loop is 2–25 mm.

46. The method of claim 40, wherein the net structure has an apparent density of 0.005–0.10 g/cm$^3$.

47. The method of claim 40, wherein the net structure has an apparent density of 0.01–0.05 g/cm$^3$.

* * * * *